US005754195A

United States Patent [19]

Yokono

[11] Patent Number: 5,754,195

[45] Date of Patent: May 19, 1998

[54] INK-TYPE RECORDING APPARATUS DETECTING INK-END MARK WITH APPROPRIATE SENSITIVITY

[75] Inventor: Masaharu Yokono, Atsugi, Japan

[73] Assignee: Ricoh Company, Ltd., Tokyo, Japan

[21] Appl. No.: 437,945

[22] Filed: May 9, 1995

[30] Foreign Application Priority Data

May 10, 1994 [JP] Japan ..... 6-095367

[51] Int. Cl.[6] ..... B41J 29/393

[52] U.S. Cl. ..... 347/19; 347/7

[58] Field of Search ..... 347/19, 16, 7, 347/171, 215, 218; 250/205, 559.01, 559.4; 327/514

[56] References Cited

FOREIGN PATENT DOCUMENTS 2221814 9/1990 Japan ..... G01D 15/00

7101076 4/1995 Japan ..... B41J 2/175

*Primary Examiner*—Benjamin R. Fuller
*Assistant Examiner*—L. Anderson
*Attorney, Agent, or Firm*—Cooper & Dunham LLP

[57] ABSTRACT

There is provided an ink-type recording apparatus in which an intensity of light emitted by a photoelectric sensor is controlled to fall within an appropriate range so as to detect an ink-end mark at an appropriate sensitivity. A light-emitting element emits light toward a recording paper. A light-receiving element converts an intensity of the received light into an output current having a level corresponding to the intensity of the light. A current/voltage converting unit converts the output current into a voltage. A digitizing unit digitizes a level of the voltage into a digital value which is one of consecutive numbers from 0 to a predetermined maximum number. A ratio of the digital value to the predetermined maximum number is calculated. An input current supplied to the light-emitting element is varied so that an intensity of the light emitted by the light-emitting element is varied in accordance with the ratio.

15 Claims, 8 Drawing Sheets

| SWITCH CONNECTION STATE | SW1 | SW1 |
|---|---|---|
| STATE (a) | OPEN | OPEN |
| STATE (b) | OPEN | CLOSED |
| STATE (c) | CLOSED | CLOSED |

FIG.6

| SWITCH CONNECTION STATE | LEVEL RATIO ($\alpha/\beta$) |
|---|---|
| STATE (a) | $1/2 < \alpha/\beta \leqq 1$ |
| STATE (b) | $1/4 < \alpha/\beta \leqq 1/2$ |
| STATE (c) | $\alpha/\beta \leqq 1/4$ |

FIG.7

| MEAN VALUE $\gamma$ | THRESHOLD VALUE |
|---|---|
| $16 \leqq \gamma \leqq 17$ | 3 |
| $18 \leqq \gamma \leqq 21$ | 4 |
| $22 \leqq \gamma \leqq 29$ | 5 |
| $30 \leqq \gamma \leqq 38$ | 6 |
| $39 \leqq \gamma \leqq 46$ | 7 |
| $47 \leqq \gamma \leqq 55$ | 8 |
| $56 \leqq \gamma \leqq 63$ | 9 |

CHECK SHEET

INK-TYPE RECORDING APPARATUS DETECTING INK-END MARK WITH APPROPRIATE SENSITIVITY

BACKGROUND OF THE INVENTION (1) The present invention relates to ink-type recording apparatuses which use ink for printing, and more particularly to an ink-type recording apparatus which determines a shortage of ink by optically detecting an ink-shortage indicating mark printed on a recording sheet.

(2) Generally, a thermal printer or an ink-jet printer is used as a printing means for printing an image on a recording paper.

The thermal printer normally uses a thermal recording paper provided in a roll. The rolled thermal recording paper is provided with a black mark at a predetermined position before a tail end of the roll so that the thermal printer can recognize a shortage of the thermal recording paper by detecting the black mark. More specifically, a threshold value is set to determine a presence of the black mark so as to compare an intensity obtained by an optoelectric sensor with the threshold value. The threshold value represents a border between black and white, the black corresponding to the intensity of the black mark, the white corresponding to the intensity of a blank portion of the thermal recording paper. Since predetermined paper materials are normally used for the thermal recording paper, an intensity corresponding to black and white can be easily determined. Accordingly, in the thermal printer, a fixed threshold value can be used for determining a presence of the black mark by comparing a measured intensity of the black mark with the threshold value.

An ink-type recording apparatus, such as the ink-jet printer, using ink to print an image also uses an ink-shortage indicating mark (hereinafter referred to as an ink-end mark) printed on a recording paper to determine a shortage of an amount of ink stored therein. Japanese Laid-Open Patent Application No. 2-221814 discloses a data processor which prints an ink-end mark on each recording paper to determine a shortage of ink stored therein. In this data processor, a photoelectric sensor detects the ink-end mark recorded on the recording paper. If the ink-end mark is not detected by the photoelectric sensor, the data processor determines that an amount of ink stored in the data processor is low.

In the above-mentioned data processor, since a fixed threshold value is used for determining whether the ink-end mark is printed, photoelectric sensors having uniform sensitivity must be used for each data processor. However, such photoelectric sensors are very expensive, and thus they are not practical for use. On the other hand, if inexpensive photoelectric sensors having a dull sensitivity and having a deviation in sensitivity are used, an accurate detection of the ink-end mark cannot be performed. Accordingly, there is a problem in that a correct determination of a shortage of ink cannot be performed. In order to eliminate such a problem, when photoelectric sensors having a deviation in sensitivity must be used, the sensitivity of each of the photoelectric sensors is adjusted. The adjustment for the photoelectric sensors is performed manually by means of a variable resistor connected to a light-receiving element of the photoelectric sensor to increase an output of the light-receiving element. However, in order to use this method, a person performing the adjustment of the sensitivity must have a sufficient knowledge about characteristics of the photoelectric sensor. Additionally, when it is judged that the photoelectric sensor is possibly malfunctioning, an output level of the photoelectric sensor must be measured each time, and thus an adjustment of the ink-end mark detecting system including the photoelectric sensor becomes difficult.

Japanese Patent Application No. 5-238607 filed by the present applicant suggested an ink-jet recording apparatus which also detects an ink-end mark recorded on a recording paper to determine a shortage of ink. This ink-jet recording apparatus adjusts an output level of a photoelectric sensor detecting the ink-end mark. More specifically, an output level of the photoelectric sensor is automatically adjusted by varying an output level of a light-receiving element of the photoelectric sensor. Accordingly, sensors having a deviation in sensitivity can be used for this ink-jet recording apparatus. However, if an intensity of light emitted from a light-emitting element of the photoelectric sensor is not sufficient, an accurate detection of the ink-end mark is not performed even if the output level of the light-receiving element is set to the maximum level because insufficient light is received by the light-receiving element. Additionally, since a constant electric current is continuously supplied to the light-emitting element during operation of the ink-jet printer, a power is always being consumed by the photoelectric sensor while the ink-jet recording apparatus is turned on, and, thus, a service life of the photoelectric sensor becomes short.

SUMMARY OF THE INVENTION

It is a general object of the present invention to provide an improved and useful ink-type recording apparatus in which the above-mentioned problems are eliminated.

A more specific object of the present invention is to provide an ink-type recording apparatus in which an intensity of light emitted by a light-emitting element of a photoelectric sensor is controlled to fall within an appropriate range so as to detect an ink-end mark at an appropriate sensitivity even if the photoelectric sensor to be used in the ink-type recording apparatus has a large deviation in sensitivity.

Another object of the present invention is to provide an ink-type recording apparatus having a low power consumption and an extended service life of the photoelectric sensor.

Another object of the present invention is to provide an ink-type recording apparatus which can provide condition information with respect to an ink-end mark detecting function upon an operator's request.

In order to achieve the above-mentioned objects, there is provided according to one aspect of the present invention an ink-type recording apparatus using ink for printing, comprising:

- a light-emitting element emitting light toward a recording paper;
- a light-receiving element receiving the light reflected by the recording paper, and converting an intensity of the received light into an output current having a level which corresponds to the intensity of the received light;
- a current/voltage converting unit converting the output current into a voltage;
- a digitizing unit digitizing a level of the voltage output from the current/voltage converting unit into a digital value which is one of consecutive numbers from 0 to a predetermined maximum number;
- ratio calculating means for calculating a ratio of the digital value to the predetermined maximum number; and
- current varying means for varying an input current supplied to the light-emitting element so that an intensity of the light emitted by the light-emitting element is varied in accordance with the ratio calculated by the ratio calculating means.

Additionally, there is provided according to another aspect of the present invention an ink-type recording apparatus using ink for printing, an ink-end mark used for detecting shortage of ink being printed at a predetermined position on a recording paper, the ink-type recording apparatus comprising:

a photoelectric sensor comprising a light-emitting element emitting light toward the recording paper when an input current is supplied to the light-emitting element, the photoelectric sensor sensing an intensity of the light reflected by the ink-end mark and a blank area of the recording paper; and current supplying means for supplying the input current to the light-emitting element only when a portion of the recording paper including the ink-end mark passes the photoelectric sensor.

Additionally, according to another aspect of the present invention an ink-type recording apparatus using ink for printing, an ink-end mark used for detecting shortage of ink being printed at a predetermined position on a recording paper, the shortage of ink being determined by comparing a difference between an intensity of light reflected by the ink-end mark and an intensity of light reflected by a blank area of the recording paper with a reference value, the ink-type recording apparatus comprising:

a light-emitting element emitting light toward the recording paper;

a light-receiving element receiving the light reflected by the recording paper, and converting an intensity of the received light into an output current having a level which corresponds to the intensity of the received light;

a current/voltage converting unit converting the output current into a voltage;

a digitizing unit digitizing a level of the voltage output from the current/voltage converting unit into a digital value;

sampling means for sampling the voltage at a predetermined sampling frequency while the recording paper is conveyed;

storing means for sequentially storing the digital value obtained from the voltage sampled by the sampling means; and printing means for printing the digital value on the recording paper in a form of a graph so that an operator visually recognizes a change in intensity between the light reflected by the blank area of the recording paper and the light reflected by the ink-end mark.

Additionally, according to another aspect of the present invention an ink-type recording apparatus using ink for printing, an ink-end mark used for detecting a shortage of ink being printed at a predetermined position on a recording paper, the shortage of ink being determined by comparing a difference between an intensity of light reflected by the ink-end mark and an intensity of light reflected by a blank area of the recording paper with a reference value, the ink-type recording apparatus comprising:

a light-emitting element emitting light toward the recording paper;

a light-receiving element receiving the light reflected by the recording paper, and converting an intensity of the received light into an output current having a level which corresponds to the intensity of the received light;

a current/voltage converting unit converting the output current into a voltage;

a digitizing unit digitizing a level of the voltage output from the current/voltage converting unit into a digital value;

sampling means for sampling the voltage at a predetermined sampling frequency while the recording paper is conveyed so that a plurality of the digital values are obtained;

maximum and minimum value obtaining means for obtaining a maximum value of the digital values and a minimum value of the digital values; and printing means for printing the maximum value, the minimum value and the reference value on the recording paper.

Other objects, features and advantages of the present invention will become more apparent from the following detailed description when read in conjunction with the accompanying drawings.

BRIEF DESCRIPTION OF THE DRAWINGS

FIG. 6 is a table showing a relationship between a range of a level ratio ($\alpha/\beta$) and states of the switch unit to be set;

FIG. 7 is a table showing a relationship between a range of a mean value $\tau$ and a threshold value;

DETAILED DESCRIPTION OF THE PREFERRED EMBODIMENTS

Figure 1:
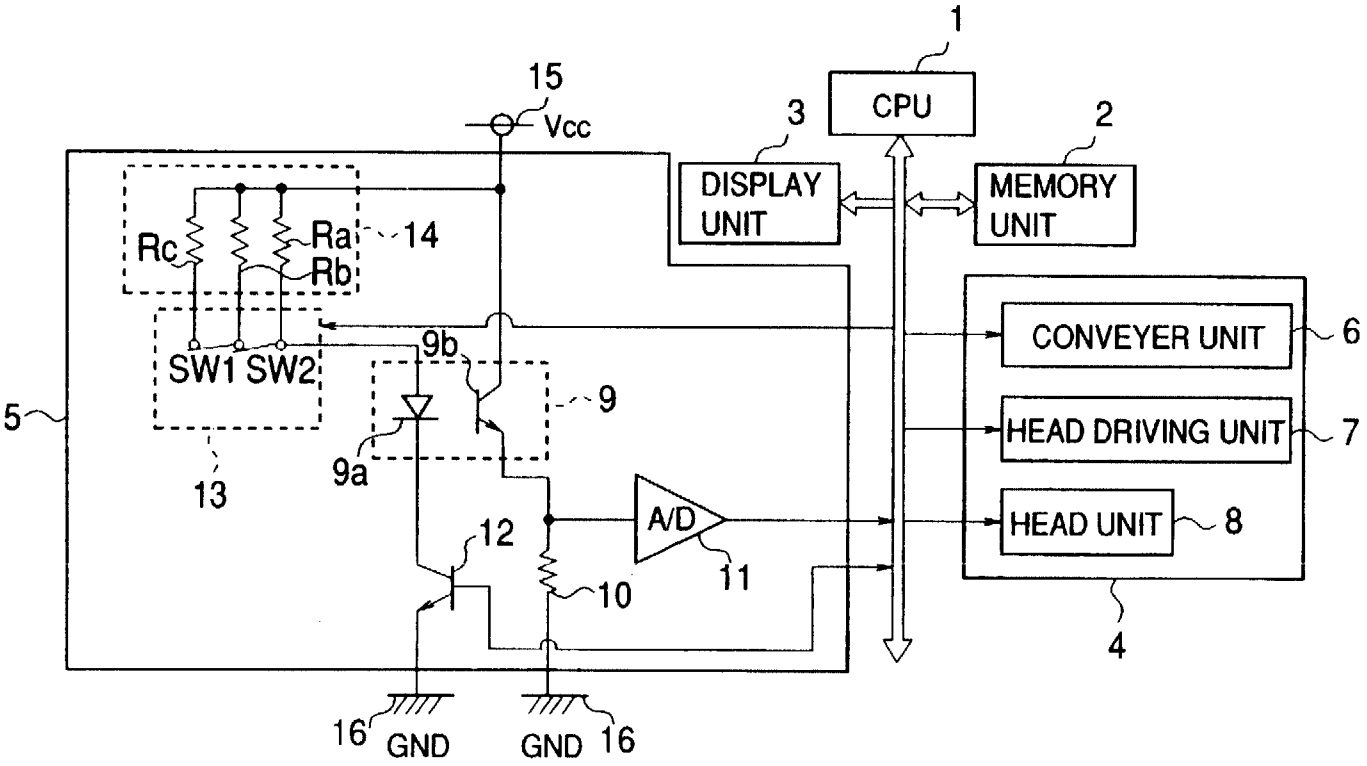
FIG. 1 is a block diagram of a first embodiment of an ink-jet printer according to the present invention.

A description will now be given, with reference to FIG. 1, of a first embodiment of an ink-jet printer according to the present invention. FIG. 1 is a block diagram of the first embodiment of the ink-jet printer according to the present invention.

In FIG. 1, a central processing unit (CPU) 1 controls each part of the ink-jet printer according to various programs stored in a read-only memory (ROM) and various sets of data. A memory unit 2 comprises the ROM and a random access memory (RAM). A static random access memory (SRAM) may be used instead of the RAM. The ROM stores a threshold value, described later, which is used to determine a shortage of ink. The RAM or SRAM stores condition information of a switch unit 13 and an output of an ink concentration sensing unit 5. A display unit 3 comprises a liquid crystal display panel so as to indicate various information to an operator. A notification of a shortage of ink is also displayed on the display unit 3. The display unit 3 may include a buzzer or an LED to provide the notification to the operator when the shortage of ink occurs.

An ink-jet unit 4 prints characters or pictures by ejecting a small amount of ink toward a recording paper according to instructions supplied by the CPU 1. The ink-jet unit 4 also prints an ink-end mark at a predetermined position on each recording paper during a printing operation of each recording paper. The ink-end mark has an intensity corresponding to completely or nearly black. The ink-jet unit 4 comprises a conveyer unit 6, a head driving unit 7 and a head unit 8. The conveyer unit 6 conveys the recording paper in a normal or a reverse direction according to instructions supplied by the CPU 1. The head driving unit 7 moves the head unit 8 in a direction perpendicular to a moving direction of the recording paper so as to move the head unit 8 to a printing position. The head unit 8 ejects a small amount of ink to print characters, pictures and also the ink-end mark onto the recording paper.

The ink concentration sensing unit 5 projects light onto the recording paper according to instructions from the CPU 1, and outputs a digital output corresponding to an amount of light reflected by the recording paper. A photoelectric sensor 9 is provided at a position where the ink-end mark can be detected. The photoelectric sensor 9 comprises a light-emitting element 9*a* and a light-receiving element 9*b*. An amount of light emitted by the light-emitting element 9*a* is determined by a current flowing thereto. The light-receiving element 9*b* receives light reflected by the recording paper, and converts the received light into a current corresponding to an amount of the light received by the light-receiving element 9*b*. A current/voltage converting resistor unit (I/V converting resistor) 10 converts a current (I) flowing in the light-receiving element 9*b* into a voltage (V), and outputs the voltage to an analog/digital (A/D) converter 11. The A/D converter 11 converts the voltage supplied by the I/V converting resistor 10 into a digital value at a sampling frequency according to a clock signal supplied by an external device (not shown in the figure). That is, a level of the voltage obtained from the I/V converting resistor 10 is converted into one of consecutive digital numbers from 0 to a predetermined number β. That is, a level of the voltage is represented by one of the numbers from 0 to β. Hereinafter the number 8 is referred to as a maximum number. In the present embodiment, as a 6-bit A/D converter is used for the A/D converter 11, a level of the voltage can be represented by 64 levels (equal to the sixth power of 2), and thus the maximum number β is equal to 63.

A transistor 12 turns on/off according to instructions from the CPU 1 to control the current supplied to the light-emitting element 9*a* of the photoelectric sensor 9. The switch unit 13 turns on/off switches SW1 and SW2 according to instructions from the CPU 1 so as to vary an intensity of the current supplied to the light-emitting element 9*a*. A current-limiting resistor unit 14 comprises three resistors Ra, Rb and Rc, connected in parallel, so that a resistance of the current-limiting resistor unit 14 is varied according to a connection state of the switch unit 13. It should be noted that the number of the resistors and the resistance of each of the resistors provided in the current-limiting resistor unit 14 may be arbitrarily determined so that a current determined by the current-limiting resistor unit 14 falls within a rated current of the light-emitting element 9*a* of the photoelectric sensor 9. Additionally, a variable resistor may be used instead of the current-limiting resistor unit 14 and the switch unit 13 so as to vary a current supplied to the light-emitting element 9*a*.

The current-limiting resistor unit 14 and the light-receiving element 9*b* are connected to a power supply 15 supplying a predetermined constant voltage. Additionally, the transistor 12 and the I/V converting resistor 10 are connected to a ground 16.

Figures 2, 3:
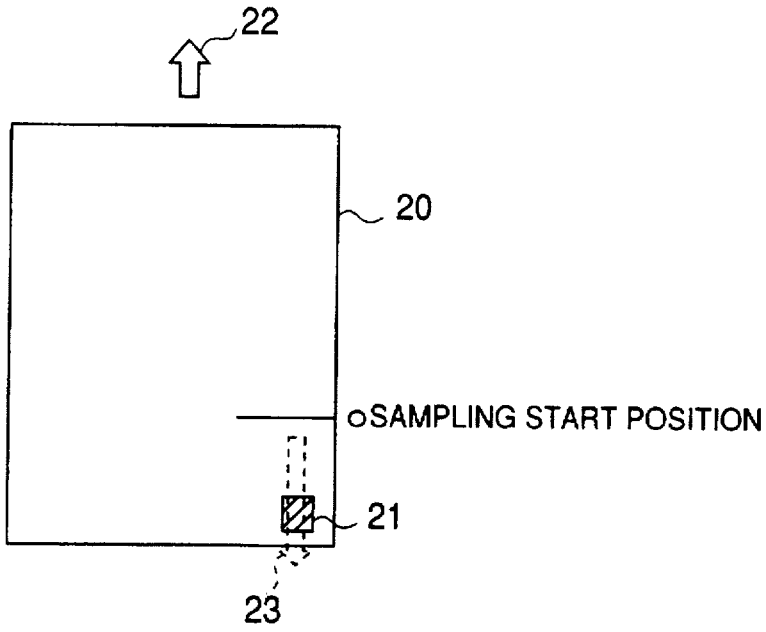
FIG. 2 is an illustration showing a recording paper and an ink-end mark printed on the recording paper.
FIG. 3 is an illustration showing connection states of a switch unit shown in FIG. 1.

FIG. 2 is an illustration showing a recording paper 20 and an ink-end mark 21 printed on the recording paper. In FIG. 2, the recording paper 20 is conveyed in a direction indicated by an arrow 22, and a sampling start position is indicated from which sampling start position a sampling of light reflected by the recording paper 20 is started. That is, the above-mentioned photoelectric sensor 9 is provided at a position corresponding to the sampling start position, and thus a sampling position moves in a direction indicated by an arrow 23 drawn by dotted lines as the recording paper 20 is moved.

In the ink-jet printer according to the present embodiment, the ink-end mark 21 is printed at a predetermined position on the recording paper 20. The transistor 12 shown in FIG. 1 is turned on at a time when the ink-end mark 21 is printed, that is, a time when the sampling start position of the recording paper 20 moves to a position corresponding to the photoelectric sensor 9. When the transistor is turned on, the current is supplied to the photoelectric sensor 9, and thus the photoelectric sensor 9 is activated. The CPU 1 then samples an output from the photoelectric sensor 9 at the sampling frequency. Since the recording paper 20 is moved in the direction indicated by the arrow 22, the sampling position is moved in the direction indicated by the arrow 23.

FIG. 3 is an illustration showing connection states of the switch unit 13 shown in FIG. 1. As shown in FIG. 3, a state in which both of the switches SW1 and SW2 are open is referred to as a state (a), a state in which the switch SW1 is open and the switch SW2 is closed is referred to as a state (b), and a state in which both of the switches SW1 and SW2 are closed is referred to as a state (c).

Figure 4:
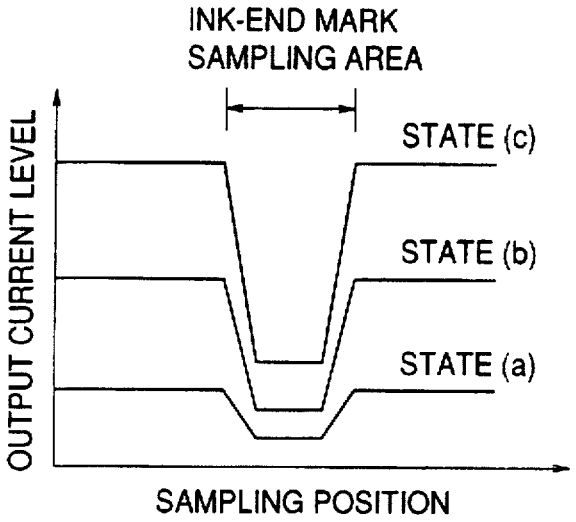
FIG. 4 is a graph showing an output level of a photoelectric sensor shown in FIG. 1 when the switch unit is set to each of the states shown in FIG. 3.

FIG. 4 is a graph showing level of output current of the photoelectric sensor 9 when the switch unit 13 is set to each of the states shown in FIG. 3. The resistance of the current-limiting resistor unit 14 is varied according to each of the states, and, therefore, the current flowing to the light-emitting element 9*a* differs for each of the states. Thus, the amount of light emitted by the light-emitting element 9*a* differs for each of the states, and, correspondingly, the amount of light received by the light-receiving element 9*b* also differs for each of the states. As a result, the level of output current of the light-receiving element 9*b* differs for each of the states as shown in FIG. 4. It should be noted that the level of the output current of the photoelectric sensor 9 decreases when the sampling position moves to an ink-end mark sampling area as indicated by each line shown in FIG. 4. It is understood from the figure that a difference between a level of output current corresponding to a blank area of the recording paper 20 and a level of output current corresponding to the ink-end mark becomes larger as the overall level of current output by the light-receiving element 9*b* is increased. Accordingly, the largest difference between the levels of output current corresponding to the blank area and the ink-end mark is obtained when the switch unit 13 is in the state (c).

Figure 5:
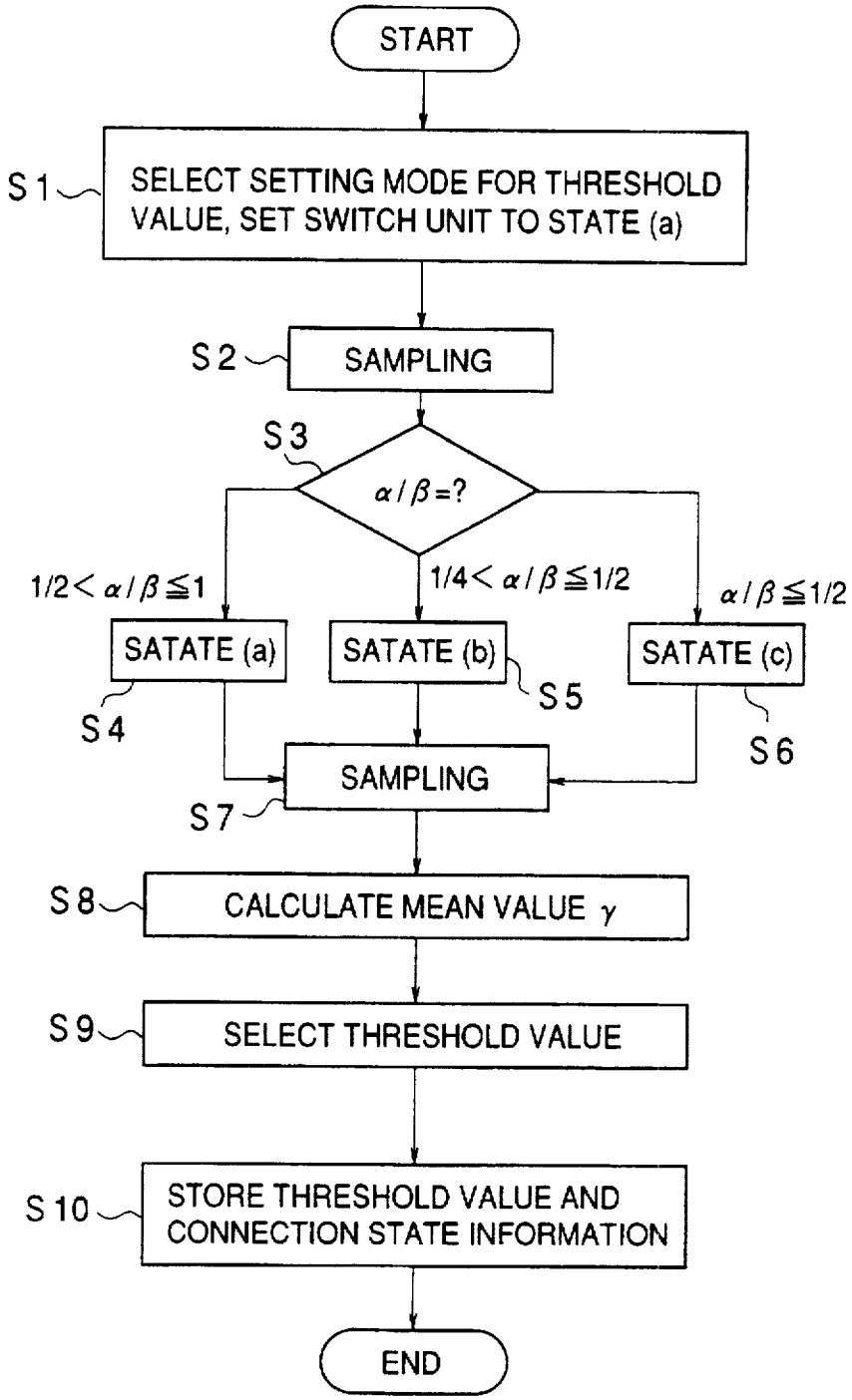
FIG. 5 is a flowchart of an initialization operation to adjust an output level of the photoelectric sensor and to determine a threshold value used for determining presence of the ink-end mark.

A description will now be given, with reference to FIGS. 1 and 5, of an operation performed in the present embodiment. FIG. 5 is a flowchart of an initialization operation to adjust the level of output current of the photoelectric sensor 9 and to determine a threshold value used for determining presence of the ink-end mark. The initialization operation is performed in a manufacturing process of the ink-jet printer.

When the initialization operation is started, a setting mode for the threshold value and the connection state is selected in step 1, and the switch unit 13 is set to the state (a). A digital value output from the A/D converter 11 is sampled, in step 2, a predetermined number of times according to the instruction from the CPU 1. The CPU 1 then calculates a mean value $\alpha$ of the sampled digital values to obtain a level ratio ($\alpha/\beta$) of the mean value a to the above-mentioned maximum number $\beta$. It is then determined, in step 3, if the level ratio ($\alpha/\beta$) falls within one of ranges shown in FIG. 6. That is, it is determined if $1/2<(\alpha/\beta)\leqq 1$, $1/4<(\alpha/\beta)\leqq 1/2$ or $(\alpha/\beta)\leqq 1/4$. If it is determined that $1/2<(\alpha/\beta)\leqq 1$, the routine proceeds to S4 in which the connection state of the switch unit 13 is maintained the same, that is, the state (a). If it is determined that $1/4<(\alpha/\beta)\leqq 1/2$, the routine proceeds to S5 in which the connection state of the switch unit 13 is changed to the state (b). If it is determined that $(\alpha/\beta)\leqq 1/4$, the routine proceeds to S6 in which the connection state of the switch unit 13 is changed to the state (c). The relationship between the range of the level ratio ($\alpha/\beta$) and the states of the switch unit 13 to be set is shown in FIG. 6.

By executing the above-mentioned steps 2 to 6, the state of the switch unit 13 is set so that the resistance of the current-limiting resistor unit 14 is varied so as to increase the current supplied to the light-emitting element 9*a* of the photoelectric sensor 9. More specifically, if the level ratio ($\alpha/\beta$) falls within a range from 1/4 to 1/2, the resistance of the current-limiting resistor unit 14 is decreased by changing the connection state of the switch unit 13 to the state (b). If the level ratio ($\alpha/\beta$) is less than 1/4, the resistance of the current-limiting resistor unit 14 is further decreased by changing the connection state of the switch unit 13 to the state (c). It should be noted that the resistance of each of the resistors Ra, Rb and Rc of the current-limiting resistor unit 14 is determined so that an appropriate current flows to the light-emitting element 9 when the resistance of the current-limiting resistor unit 14 is varied as mentioned above. Accordingly, the digital value output from the A/D converter 11 always falls in the range from a middle to the maximum level.

After the switch unit 13 is set to one of the states (a) to (c), the routine proceeds to step 7. In step 7, a predetermined number of samplings are performed for the voltage output from the photoelectric sensor 9 which voltage corresponds to a blank area of the recording paper 20. The sampled voltages are converted into digital values by the A/D converter 11, and a mean value $\tau$ of the digital values is calculated by the CPU 1 in step 8.

After the mean value $\tau$ is calculated, the routine proceeds to step 9 in which an appropriate threshold value (reference value) is selected by a relationship between a range of the mean value $\tau$ and the threshold value shown in FIG. 7. The threshold value is used to determine whether or not the ink-end mark is clearly printed on the recording paper 20. More specifically, if a difference between the digital value corresponding to the ink-end mark 23 and the digital value corresponding to the blank area of the recording paper 20 is greater than the threshold value, the ink-end mark 23 is determined as being completely black. It should be noted that the ranges of the mean value and the threshold values shown in FIG. 7 were determined by experiment. After the appropriate threshold value is selected, the selected threshold value is stored, in step 10, in the memory unit 2 together with information of the connection state of the switch unit 13, and the routine is ended.

The threshold value stored in the memory unit 20 remains until the above-mentioned initialization operation is performed again. The initialization operation must be performed when the photoelectric sensor 9 is replaced with a new one due to some reasons such as a malfunction of the photoelectric sensor 9. In such a case, the threshold value and the information for the connection state which were previously stored in the memory unit 20 are overwritten.

In the above-mentioned initialization operation, since the connection state of the switch unit 13 is changed in step 5 or 6 so that the level ratio ($\alpha/\beta$) of the mean value a to the maximum number $\beta$ falls between 1/2 to 1, an intensity of the light emitted by the light-emitting element 9*a* is adjusted to an appropriate level. Accordingly, a half to a full range of the levels output from the A/D converter 11 can always be used, which condition results in an appropriate sensitivity of the detection of the ink-end mark 23. Additionally, since the current supplied to the light-emitting element 9*a* is set to an appropriate value at the initial stage, an excessive current does not flow in the light-emitting element 9*a*, and thus a long service life of the photoelectric sensor 9 is obtained.

Figure 8:
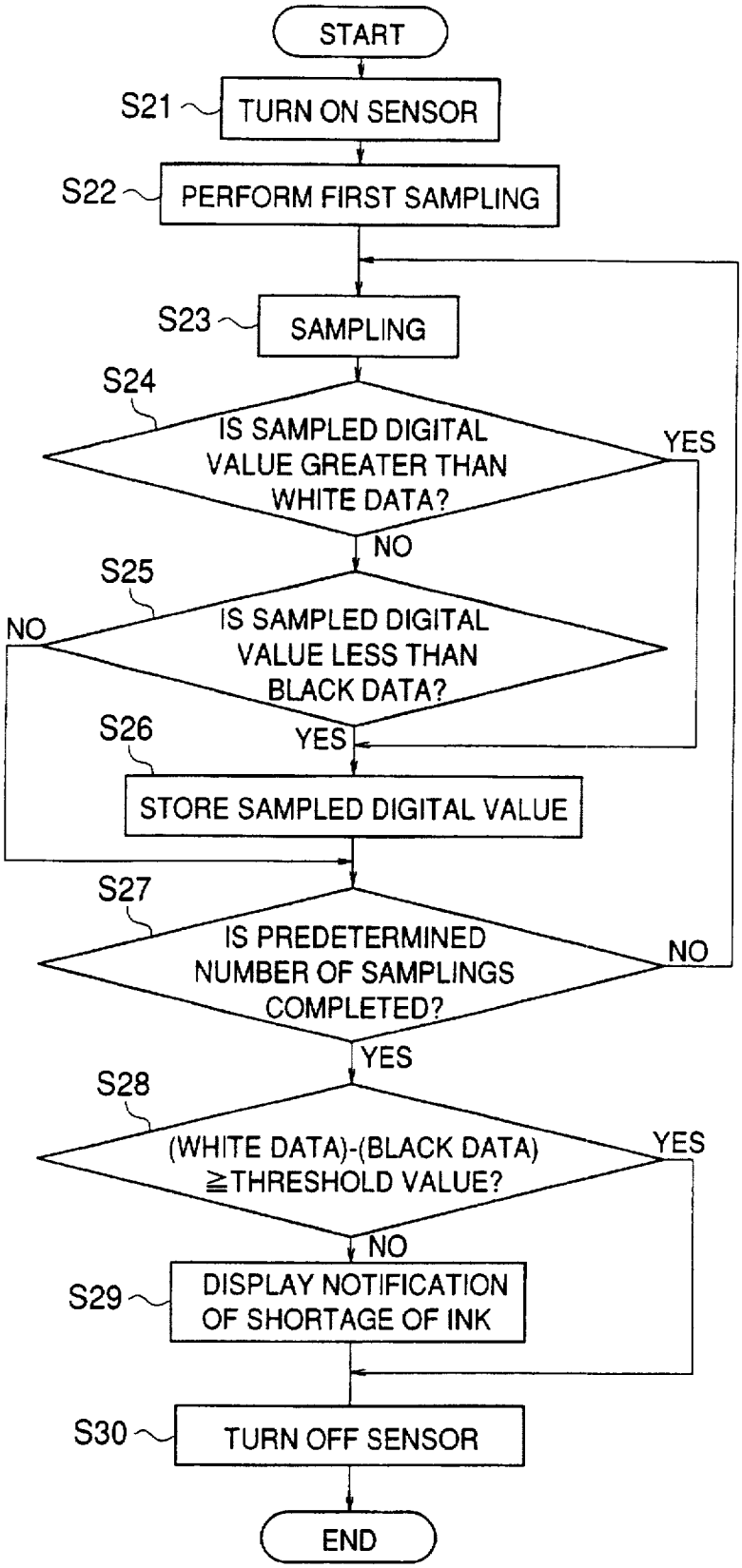
FIG. 8 is a flowchart of an operation of a second embodiment of the ink-jet printer according to the present invention.

A description will now be given, with reference to FIGS. 1 and 8, of a second embodiment of the ink-jet printer according to the present invention. FIG. 8 is a flowchart of an operation of the second embodiment of the ink-jet printer according to the present invention. It should be noted that the ink-jet printer of the second embodiment has a construction the same as that shown in FIG. 1, and descriptions of parts of the second embodiment that are the same as the parts shown in FIG. 1 are omitted. The operation shown in FIG. 8 is performed while a printing operation for each recording paper is performed on the user's side When the operation shown in FIG. 8 is started, the CPU 1 turns on, in step 21, the transistor 12 so as to supply a current to the light-emitting element 9*a* of the photoelectric sensor 9 at the same time when the ink-end mark 23 is printed on the recording paper 20. A first sampling is performed, in step 22, to obtain from the A/D converter 11 a first digital value corresponding to an intensity of a blank area of the recording paper 20. The first digital value is stored in a memory unit 2 as both black data and white data. The black data corresponds to an intensity of the light reflected by the ink-end mark 23 and the white data corresponds to an intensity of the light reflected by the blank area of the recording paper 20.

After the first digital value is stored as initial values for both the black data and the white data, another sampling is performed, in step 23, so as to obtain a second digital value which corresponds to the next sampling position of the recording paper 20. It is determined, in step 24, whether or not the second digital value is greater than the white data stored in the memory unit 2. If it is determined that the second digital value is greater than the white data, the routine proceeds to step 26. In step 26, the second digital value is substituted for the white data already stored in the memory unit 2, and the routine proceeds to step 27 in which it is determined whether or not a predetermined number of samplings have been performed. The predetermined number of samplings are determined so that the sampling position passes the ink-end mark 23 and is moved to an opposite side of the ink-end mark 23 when the predetermined number of samplings are completed.

On the other hand if it is determined in step 24 that the second digital value is not greater than the white data, the routine proceeds to step 25. In step 25, it is determined whether or not the second digital value is less than the black data stored in the memory unit 2. If it is determined that the second digital value is less than the black data, the routine proceeds to step 26 in which the second data is substituted for the black data already stored in the memory unit 2. The routine then proceeds to step 27 so as to determine whether or not the predetermined number of samplings have been performed.

On the other hand, if it is determined in step 25 that the second digital value is not less than the black data already stored in the memory unit 2, the routine proceeds to step 27 so as to determine whether or not the predetermined number of samplings have been performed.

If it is determined in step 27 that the predetermined number of samplings have not performed, the routine returns to step 23 to repeat steps from 23 to 27. If it is determined that the predetermined number of samplings have been performed, the routine then proceeds to step 28. When the above-mentioned steps from 22 to 27 have been completed, the white data and the black data stored in the memory unit 2 have become, respectively, the maximum digital value and the minimum digital value that are obtained while the predetermined number of samplings are performed. This means that the black data after the predetermined number of samplings represents the ink-end mark 23 printed on the recording paper 20, and the white data after the predetermined number of samplings represents the blank area of the recording paper 20.

It is then determined in step 28 whether or not a difference between the white data and the black data stored in the memory unit 2 is equal to or greater than the threshold value stored in the memory unit 2. This threshold value has been stored in the memory unit 2 in the initialization operation mentioned above. If it is determined that the difference is less than the threshold value, the routine proceeds to step 29 to notify a user that a shortage of ink has occurred through the display unit 3. After the notification of the shortage of ink is made, the routine proceeds to step 30 in which the transistor 12 is turned off so as to cut off the current supplied to the light-emitting element 9*a*, and the routine is ended. If it is determined in step 28 that the difference is equal to or greater than the threshold value, the routine proceeds to step 30 to turn off the transistor 12.

According to the above-mentioned operation, the current is supplied to the light-emitting element 9*a* only when the ink-end mark 23 is moved to a position close to the ink-end mark 23, and the current is immediately cut off after the detecting operation of the ink-end mark 23 is completed. Accordingly, the current consumed by the photoelectric sensor 9 is reduced, and thus a power consumption of the ink-jet printer according to the present embodiment is reduced. Additionally, since the light-emitting element 9*a* is not always be turned on, a service life of the photoelectric sensor is increased as compared to the conventional printer in which a light-emitting element is always turned on while a printing operation is performed.

Figure 9:
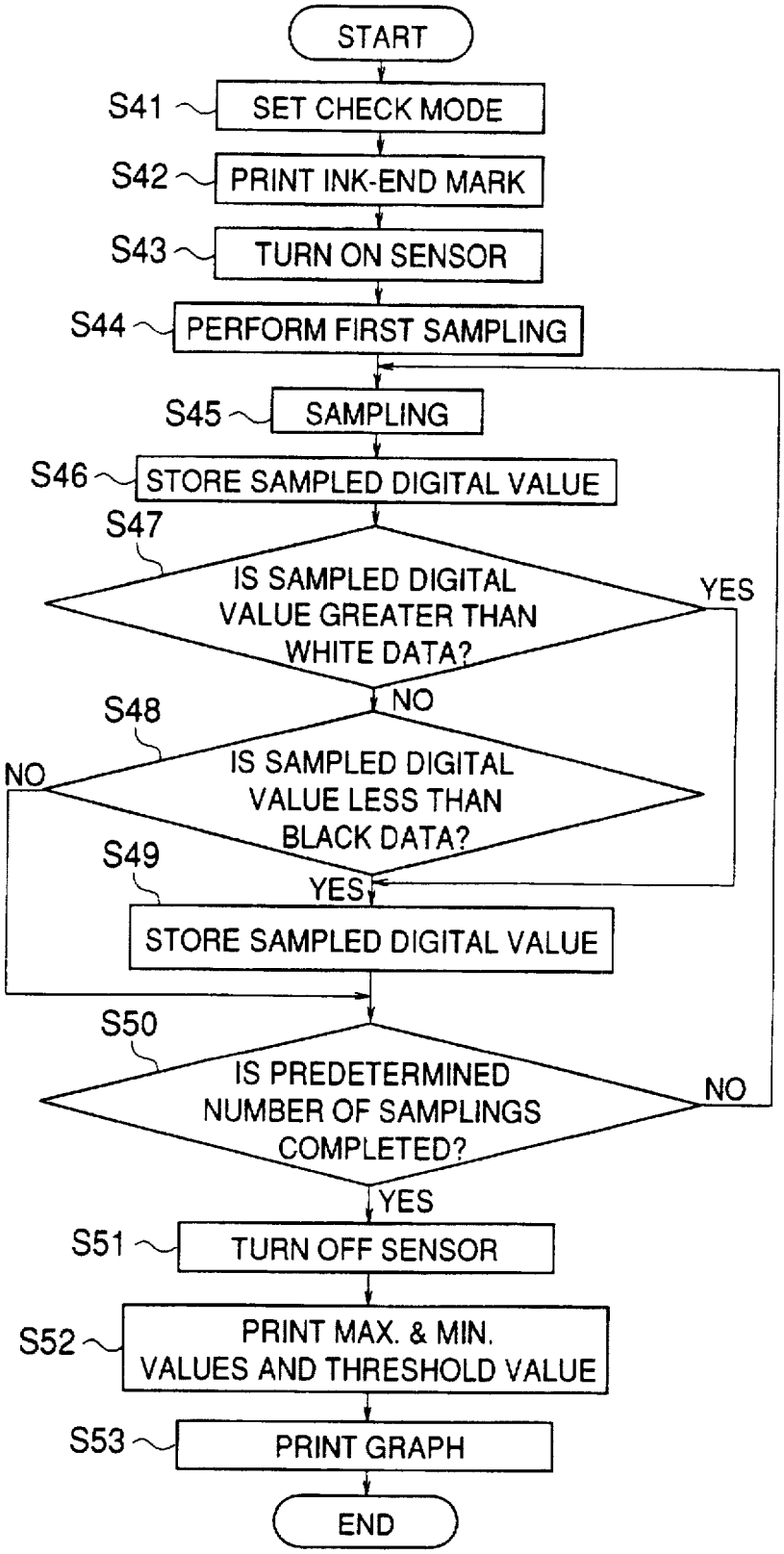
FIG. 9 is a flowchart of an operation of a third embodiment of the ink-jet printer according to the present invention.

A description will now be given, with reference to FIGS. 1 and 9, of a third embodiment of the ink-jet printer according to the present invention. FIG. 9 is a flowchart of an operation of the third embodiment of the ink-jet printer according to the present invention. It should be noted that the ink-jet printer of the third embodiment has a construction the same as that shown in FIG. 1, and descriptions of parts of the third embodiment that are the same as the parts shown in FIG. 1 are omitted. The operation shown in FIG. 9 is performed to check whether an ink-end mark detecting operation performed by the ink concentration sensing unit 5 is normal. This operation must be performed when the photoelectric sensor 9 is replaced with new one.

The operation shown in FIG. 9 is started when a user or an operator selects a check mode for checking the ink-end mark detecting operation performed by the ink concentration detecting unit 5. The operation shown in FIG. 9 is started, in step 41, when the check mode is selected by the operator through an inputting unit (not shown in FIG. 1). When the check mode is selected, an ink-end mark is printed, in step 42, on a predetermined position on a check sheet (a recording paper). The CPU 1 then turns on, in step 43, the transistor 12 so as to supply a current to the light-emitting element 9*a* of the photoelectric sensor 9.

The steps from 43 to 50 are the same as the steps from 21 to 27 shown in FIG. 8 except that the additional step 46 is added to the operation shown in FIG. 9. The step 46 is added to store each of the digital values output from the A/D converter 11, in turn, in the memory unit 2 while the predetermined number of samplings are performed. The digital values are stored in such a manner that the digital values can be output from the memory unit 2 in an order in which the digital value stored first is output first.

Figure 10:
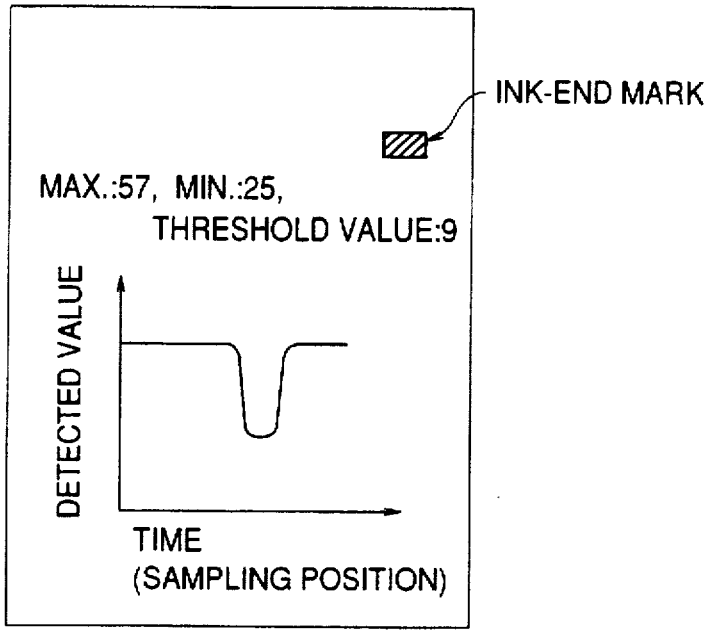
FIG. 10 is an illustration of a recording paper printed according to the operation shown in FIG. 9.

In the present embodiment, when the predetermined number of samplings are completed, the routine proceeds to step 51 to turn off the transistor 12 to cut off the current supplied to the light-emitting element 9*a*. The maximum value and the minimum value of the digital values obtained during the predetermined number of samplings are printed, in step 52, on the check sheet on which the ink-end mark is printed in step 42. The threshold value stored in the memory unit 2 is also printed on the check sheet. The digital values (detected values) stored in the memory unit are plotted, in step 53, in a form of a graph shown in FIG. 10.

By performing the above-mentioned operation, the operator can obtain the condition information of the ink concentration sensing unit 5, if it is needed, so as to check whether the ink concentration sensing unit 5 is operating correctly. Since the condition information which includes digital values output from the A/D converter 11 is printed in the form of the graph, the operator can easily recognize the condition of the ink concentration sensing unit 5.

The present invention is not limited to the specifically disclosed embodiments, and variations and modifications may be made without departing from the scope of the present invention.

What is claimed is:

1. An ink-type recording apparatus using ink for printing, comprising:

a light-emitting element emitting light toward a recording paper;

a light-receiving element receiving the light reflected by the recording paper, and converting intensity of the received light into an output current having a level which corresponds to the intensity of the received light;

a current/voltage converting unit converting the output current into a voltage;

a digitizing unit digitizing a level of said voltage output from said current/voltage converting unit into a digital value which is one of consecutive numbers from 0 to a predetermined maximum number;

a processor for calculating a ratio of said digital value to said predetermined maximum number and;

current varying means for varying an input current supplied to said light-emitting element so that an intensity of the light emitted by said light-emitting element is varied in accordance with said ratio calculated by said processor.

2. The ink-type recording apparatus as claimed in claim 1, wherein said current varying means comprises resistance changing means for changing a resistance of a line through which said input current supplied to said light-emitting element flows.

3. The ink-type recording apparatus as claimed in claim 2, wherein said resistance changing means comprises a resistor unit having a plurality of resistors connected in parallel, said resistor changing means further comprising a switch unit which disconnects at least one of said resistors from said line.

4. The ink-type recording apparatus as claimed in claim 3, wherein said switch unit comprises a plurality of switches connected in series, each of said switches connected between two of said resistors.

5. The ink-type recording apparatus as claimed in claim 1, wherein said current varying means varies a first level of said input current to a second level which is higher than said first level when said ratio calculated from said digital value which corresponds to said voltage obtained when said light-emitting receiving element receives the light reflected by a blank area of said recording paper is equal to a predetermined value.

6. The ink-type recording apparatus as claimed in claim 5, wherein said predetermined value is greater than ¼ and equal to or less than ½.

7. The ink-type recording apparatus as claimed in claim 5, wherein said predetermined value is equal to or less than ¼.

8. The ink-type recording apparatus as claimed in claim 1, wherein said processor also samples said voltage at a predetermined sampling frequency while said recording paper is conveyed so that a plurality of said digital values are obtained, calculates a mean value of said digital values, and selects one of reference values previously stored in said ink-type recording apparatus in accordance with said mean value, each of said reference values being determined for a respective range of said mean value, said apparatus further comprising:

storing means for storing said one of said reference values so that said one of said reference values is used for determining presence of an ink-end mark.

9. An ink-type recording apparatus using ink for printing, an ink-end mark used for detecting shortage of ink being printed at a predetermined position on a recording paper, said ink-type recording apparatus comprising:

a photoelectric sensor comprising a light-emitting element emitting light toward said recording paper when an input current is supplied to said light-emitting element, said photoelectric sensor sensing an intensity of the light reflected by said ink-end mark and a blank area of said recording paper;

a processor for indicating when a portion of said recording paper including said ink mark passes said photoelectric sensor; and current supplying means for supplying said input current to said light-emitting element only when the portion of said recording paper including said ink-end mark passes said photoelectric sensor.

10. The ink-type recording apparatus as claimed in claim 9, wherein said current supplying means comprises a switch unit which opens a line of said input current so as to cut off said input current flowing to said light-emitting element.

11. The ink-type recording apparatus as claimed in claim 10, wherein said switch unit comprises a transistor provided between said light-emitting element and the ground.

12. The ink-type recording apparatus as claimed in claim 10, wherein said photoelectric sensor is provided ahead of a printing head in a direction in which said recording paper is conveyed, and said switch unit closes said line to supply said input current when said ink-end mark is being printed on said recording paper by means of said printing head.

13. An ink-type recording apparatus using ink for printing, an ink-end mark used for detecting shortage of ink being printed at a predetermined position on a recording paper, the shortage of ink being determined by comparing a difference between an intensity of light reflected by said ink-end mark and an intensity of light reflected by a blank area of said recording paper with a reference value, said ink-type recording apparatus comprising:

a light-emitting element emitting light toward said recording paper;

a light-receiving element receiving the light reflected by the recording paper, and converting an intensity of the received light into an output current having a level which corresponds to the intensity of the received light;

a current/voltage converting unit converting the output current into a voltage;

a digitizing unit digitizing a level of said voltage output from said current/voltage converting unit into a digital value;

a processor for sampling said voltage at a predetermined sampling frequency while said recording paper is conveyed;

storing means for sequentially storing said digital value obtained from said voltage sampled by said processor; and printing means for printing said digital value on said recording paper in a form of a graph that an operator can view to visually recognize a change in intensity between the light reflected by the blank area of said recording paper and the light reflected by said ink-end mark.

14. The ink-type recording apparatus as claimed in claim 13, wherein said digital value is plotted in said graph having a time axis.

15. An ink-type recording apparatus using ink for printing, an ink-end mark used for detecting a shortage of ink being printed at a predetermined position on a recording paper, the shortage of ink being determined by comparing a difference between an intensity of light reflected by said ink-end mark and an intensity of light reflected by a blank area of said recording paper with a reference value, said ink-type recording apparatus comprising:

a light-emitting element emitting light toward said recording paper;

a light-receiving element receiving the light reflected by the recording paper, and converting an intensity of the received light into an output current having a level which corresponds to the intensity of the received light;

a current/voltage converting unit converting the output current into a voltage;

a digitizing unit digitizing a level of said voltage output from said current/voltage converting unit into a digital value;

a processor for sampling said voltage at a predetermined sampling frequency while said recording paper is conveyed so that a plurality of said digital values are obtained, said processor also obtaining a maximum value of said digital values and a minimum value of said digital values; and printing means for printing said maximum value, said minimum value and said reference value on said recording paper.

* * * * *